US005175394A

United States Patent [19]

Sowash

[11] Patent Number: 5,175,394

[45] Date of Patent: * Dec. 29, 1992

[54] SABOT BULLET

[75] Inventor: Robert P. Sowash, Santa Cruz, Calif.

[73] Assignee: Olin Corporation, Cheshire, Conn.

[ * ] Notice: The portion of the term of this patent subsequent to May 7, 2008 has been disclaimed.

[21] Appl. No.: 528,670

[22] Filed: May 24, 1990

Related U.S. Application Data

[63] Continuation-in-part of Ser. No. 397,363, Aug. 22, 1989, Pat. No. 5,016,538, which is a continuation of Ser. No. 246,898, Sep. 16, 1988, abandoned, which is a continuation of Ser. No. 31,721, Mar. 30, 1987, abandoned.

[51] Int. Cl.[5] ..... F42B 14/06

[52] U.S. Cl. ..... 102/522

[58] Field of Search ..... 102/501, 520, 522

[56] References Cited

U.S. PATENT DOCUMENTS

| | | | |
|---|---|---|---|
| 3,726,231 | 4/1973 | Kelly et al. | 102/93 |
| 3,762,332 | 10/1973 | Witherspoon | 102/522 |
| 3,814,019 | 6/1974 | Hines, Jr. | 102/91 |
| 3,911,824 | 10/1975 | Barr et al. | 102/522 |
| 3,927,618 | 12/1975 | Engel | 102/93 |
| 4,005,660 | 2/1977 | Pichard | 102/92.1 |
| 4,048,922 | 9/1977 | Buljovcic | 102/92.7 |
| 5,016,538 | 5/1991 | Sowash | 102/520 |

FOREIGN PATENT DOCUMENTS

| | | | |
|---|---|---|---|
| 2313656 | 3/1975 | France . | |
| 347979 | 7/1937 | Italy | 102/501 |
| 1041865 | 5/1981 | U.S.S.R. . | |
| 1068694 | 1/1984 | U.S.S.R. . | |
| 83/01300 | 4/1983 | World Int. Prop. O. | 102/523 |

*Primary Examiner*—Deborah L. Kyle
*Attorney, Agent, or Firm*—John R. Wahl

[57] ABSTRACT

The sabot bullet has a rearwardly tapered front part and a forwardly tapered rear part converging toward each other and spaced from each other by an integral connecting part. The sabot for the bullet has two mating segments each having complementary shaped tapered front and rear cavity parts converging toward an integral interconnecting part. Each segment has a transverse flat disk portion at the rear of the rear part. The segments form an integral, transverse circular disk which abutts the rear end face of the projectile when the sabot segments are joined about the bullet.

1 Claim, 2 Drawing Sheets

FIG-3
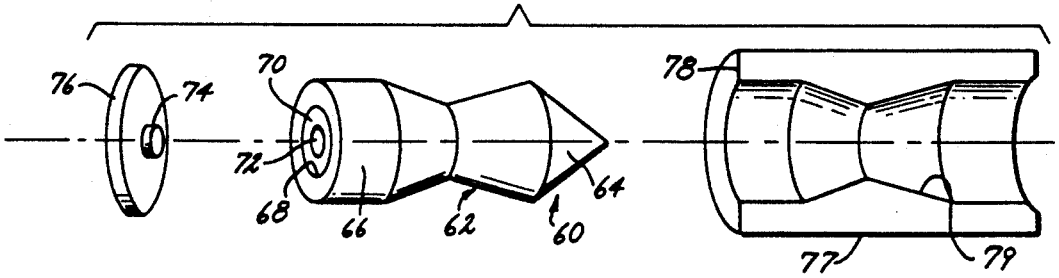
FIG-4
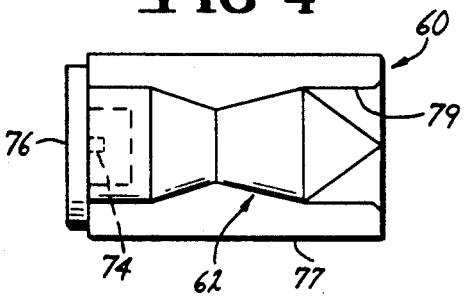
FIG-4A
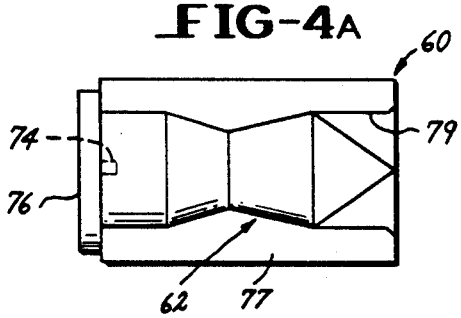
FIG-5
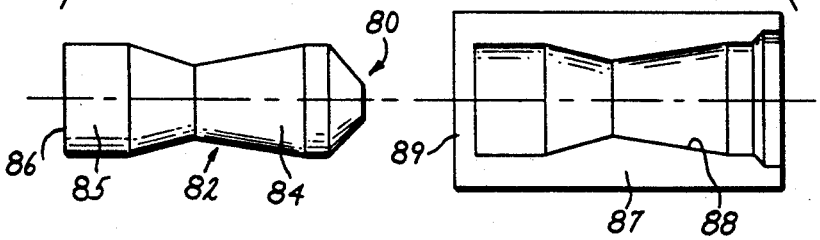
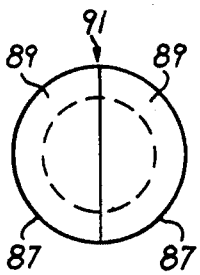
FIG-5A
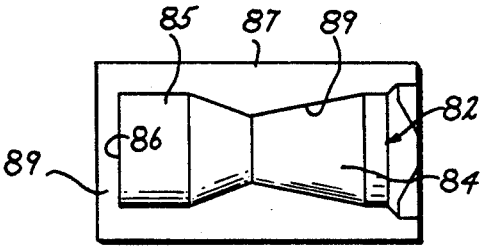
FIG-6

SABOT BULLET

This is a continuation-in-part of application Ser. No. 397,363, filed Aug. 22, 1989 now U.S. Pat. No 5,016,538, which was a continuation of application Ser. No. 246,898, filed Sep. 16, 1988, now abandoned, which was a continuation of application Ser. No. 031,721, filed Mar. 30, 1987, now abandoned.

This invention relates to improvements in sabot bullets and, more particularly, to an improved bullet body and sabots for such a bullet.

BACKGROUND OF THE INVENTION

Sabot bullets have been known and used in the past for a number of years. A disclosure relating to such a bullet includes U.S. Pat. No. 3,726,231. In that disclosure, a sabot bullet is described in which the bullet body of the sabot bullet has two conical parts which are integral with and converge to each other and diverge outwardly as the conical parts extend away from their junction. While this construction of a sabot bullet body has been satisfactory in many instances, it has also proven to be a drawback inasmuch as the bullet body has a tendency to break at the junction. This thereby minimizes the penetration of the bullet body in a target which is struck by the bullet body after being shot from a gun. Because of this problem, a need exists for improvements in the construction of a bullet body of a sabot bullet.

SUMMARY OF THE INVENTION

An embodiment of the bullet body of the present invention includes a front part of a first, metallic material and a rear part of a second, lighter weight material, such as plastic, wood or the like. The presence of the second part eliminates the need for the drilling and plugging of the first part. The invention also provides that the overall bullet body is of lighter weight, enhanced forward positioning of the center of gravity of the body, results in a higher velocity of travel of the bullet body after being fired, and provides more stability and accuracy for the bullet body in flight.

Another embodiment of the present invention is directed to an armor piercing bullet body having at least a pair of sabots associated therewith. The bullet body has a pointed front end and the sabots form a conical front opening surrounding the front end. Grooves on the inner surface of each sabot communicate with the recess at the front of the sabots to receive air from the recess to assist in stripping the sabots from the bullet body when a sabot bullet has been fired from a shotgun.

Still another embodiment of the present invention is a bullet body having a rear end provided with a recess for receiving a projection on a disk-like pusher member which abuts the rear end faces of a pair of sabots which mate with the bullet body to form a sabot bullet. The projection received in the recess orients the pusher member and the pusher member stabilizes and keeps the sabots from coming apart from the bullet body prior to exit of the bullet body from the muzzle of a shotgun from which the sabot bullet is fired. The stabilizing effect of the pusher member is needed because of the higher gas pressures at firing, and the application of more modern bullet parts and higher muzzle velocities for the sabot bullet itself.

Still another embodiment of the invention includes a sabot bullet having a bullet body received within the inner recesses formed by at least a pair of sabots. Each sabot has a rear end provided with an integral segment of a disk and this provides a structure which keeps the sabot bullet and the sabots from separating or changing positions when the sabot bullet is fired. The disk-like segment is used when the bullet body is to be fired at lower gas pressures.

The pusher member and integral segment concept are to be considered different from each other and the characteristics which they impart to sabot bullet also differ; however, in some instances, they could be used together for increased and improved accuracy, for higher muzzle velocities and for safety.

An object of the present invention is to provide a sabot bullet of improved construction which has a front part of metallic material and a rear part of light weight material, such as plastic to thereby eliminate drilling and plugging of the bullet body and to result in a higher velocity of the bullet when shot from a shotgun and to provide good aerodynamic stability and accuracy when the sabot bullet is in flight.

Another object of the present invention is to provide a sabot bullet which uses a sabot separation principle resulting in more uniform separation by using airflow between the sabots and a bullet body to open the sabots in a manner similar to the opening of flower petals.

A further object of this invention is to provide a sabot bullet whose rear end is provided with a pusher member or a disk to enhance accuracy, to provide higher muzzle velocities and to increase safety.

Other objects of this invention will become apparent as the following specification progresses, reference being made to the accompanying drawings for an illustration of the invention.

BRIEF DESCRIPTION OF THE DRAWINGS

FIG. 3 is an exploded view of a sabot bullet having a bullet body, a pair of sabots and a disk-like pusher member adapted to be coupled to the rear end of the bullet body in abutting relationship to the end faces of the sabots;

FIG. 4 is a side elevational view of the sabot bullet of FIG. 3 in an assembled form but showing one of the sabots removed and showing the pusher member in place at the rear of the bullet body;

FIG. 4A is a view similar to FIG. 4 but showing a modified form of the bullet body, specifically the annular, strengthened center section thereof;

FIG. 5 is a view similar to FIG. 3 but showing still another embodiment of the sabot bullet of the present invention, with each pair of sabots of the sabot bullet having a rear segment for abutting a portion of the rear end face of the bullet body;

FIG. 5A is a rear elevational view of one of the sabots of the sabot bullet of FIG. 5; and FIG. 6 is a view of the sabot bullet of FIG. 5 in an assembled form and showing the disk-like rear segment on the sabot adjacent to and abutting a portion of the rear end face of the sabot bullet body.

DETAIL DESCRIPTION OF THE DRAWINGS

Figure 1:
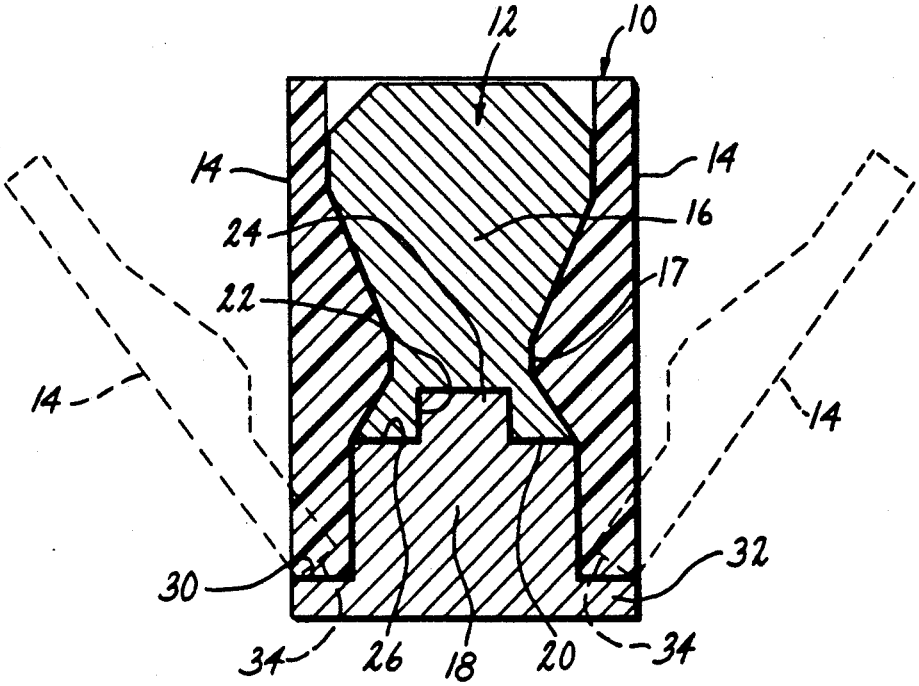
FIG. 1 is a first embodiment of the sabot bullet of the present invention.

A first embodiment of the sabot bullet of the present invention is shown in FIG. 1 and broadly denoted by the numeral 10. Bullet 10 includes a bullet body 12 and at least a pair of sabot segments 14 which have outer surfaces which are partially cylindrical and which mate to surround and substantially enclose bullet body 12.

Bullet body 12 has a front part 16 and a rear part 18 which mate together to form bullet body 12. Part 16 is formed from a suitable metallic material, such as lead; whereas, part 18 is formed from a relatively light weight material, such as plastic. An epoxy or other thermoplastic material is suitable for this use. Front part 16 has a central, annular part 17 which may be cylindrical as shown or may be transversely concave at its outer surface.

Part 16 has a rear annular end face 20 which surrounds a rear recess 22 in part 16. The recess 22 receives, by a press fit, a projection 24 integral with part 18 which also has a front, flat, annular face 26 which mates with and engages end face 20 of part 16. Rear part 18 has a cylindrical outer surface 28 which terminates at an annular shoulder 30 on an annular end part 32 at the rear end of and integral with part 18. The semi-circular rear end faces 34 on sabot segments 14 engage annular surface 20 so that the surface 30 provides fulcrum points for the sabot segments 14 as the same separate from bullet body 12 during flight of bullet 10 through the air after bullet 10 has been projected from a gun.

In use, bullet 10 is placed in a shell casing. Then the shell is placed in a shotgun and the shell is fired, causing bullet 10 to be projected through the air along a trajectory. As the bullet moves through the air, sabot segments 14 separate from the bullet body 12 by pivoting off surface 30 as a fulcrum point.

The use of part 18 coupled with part 16 to form bullet body 12 eliminates drilling and plugging of the base of part 16. It provides a lighter weight for bullet body 12 which results in a higher velocity of travel of the bullet body and a more stable or more accurate movement of the bullet body to the target.

Figure 2:
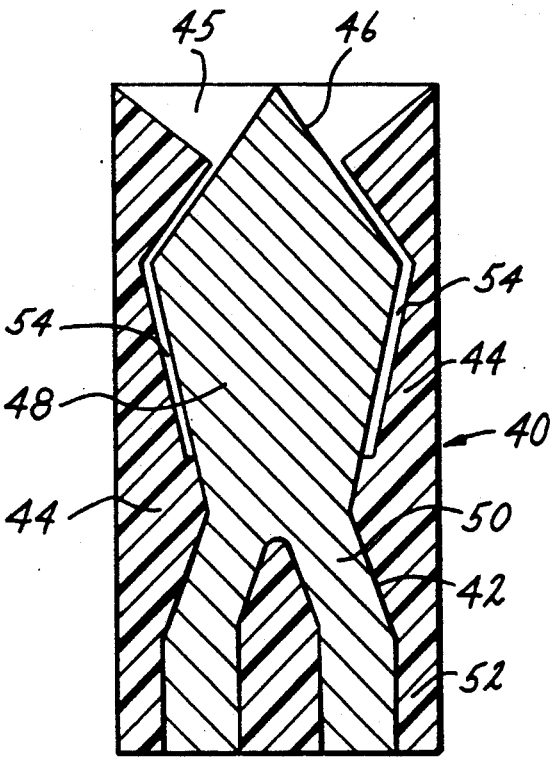
FIG. 2 is a view similar to FIG. 1 but showing a second embodiment of the sabot bullet in the form of an armor piercing sabot bullet.

An armor piercing sabot bullet 40 is shown in FIG. 2. It includes a bullet body 42 and at least a pair of sabots or sabot segments 44 which embrace bullet body 42, such as when the sabot bullet 40 is in a conventional shotgun shell. Bullet body 40 has a pointed front end 46 which is conical in configuration, the pointed front end 46 being coupled to an intermediate portion 48 which is circular in cross-section. Bullet body 42 further includes a third, frusto-conical part 50 and a fourth part 52 which is a cylindrical extension of part 50.

The sabot segments 44 are cut away at their front ends to form a conical recess 45. This recess receives air when the bullet emerges from a gun barrel after being fired, and the air in the recess 45 strips the sabot segments off body 42 much faster then if the recess 45 were not present. Sabot segments 44 have grooves defining air passages 54 on their inner surfaces to assist in stripping the sabot segments 44 from body 42. The passages 54 extend from locations near intermediate portion 48 to and communicating with recess 45. There may be one or more passages 54 for each sabot segment.

In use, when the sabot bullet 40 is fired, sabot segments 44 strip away from the bullet body 42 and the bullet body proceeds to a target. Since the pointed front end 46 is shaped as shown in FIG. 4, bullet body 42 can pierce armor of a predetermined thickness.

Another embodiment of the sabot bullet of the present invention is broadly denoted by the numeral 60 and is shown in FIGS. 3 and 4. Sabot bullet 60 includes a bullet body 62 having a front part 64 and a rear part 66, the rear part having a recess 68 therein for receiving a plug 70 of wood or plastic. The plug has a central recess or hole 72 for receiving a projection 74 on a disk-like pusher member 76 which is adapted to abut the rear flat end face of part 66 of bullet body 62. Moreover, the pusher member 76 is adapted to abut the end faces 78 of a pair of sabots or sabot segments 80 which are associated with bullet body 62. While a pair of sabots 80 are described herein as associated with bullet body 62, it is to be understood that two or more such sabots could be used with the bullet body in surrounding relationship thereto, if desired. The inner surface 82 of each sabot 80 is complementary to the outer surface of the bullet body.

When assembled, the sabot bullet 60, as shown in FIG. 4, has a bullet body 62 within the sabots 80 so that the sabots present a cylindrical outer surface for the sabot bullet 60. The pusher disk-like member 76 is shown with its projection 74 received within recess 72 such that the front flat face of member 76 not only abuts the rear flat end face of the bullet body but also abuts at its outer peripheral margin the end faces 78 of sabots 80. Member 76 may or may not have the same outer diameter as the sabots. As shown in FIG. 4, the member 76 has a diameter less than the maximum diameter of the sabots.

FIGS. 3 and 4 show a sharp discontinuity between front and rear parts 64 and 66; however, this discontinuity could be replaced by a cylindrical extension such as extension 17 of the bullet body of FIG. 1. In the alternative, and as shown in FIG. 4A, this junction between the front and rear parts 64 and 66 of bullet body 62 can be elongated and provided with a transversely concave outer surface to strengthen the junction between the two parts 64 and 66.

The pusher member 76 is like a thin washer which ranges in thickness from approximate 1/20th of an inch (0.05") to ¼th of an inch (0.25") depending upon the use to which sabot bullet 60 is put. Projection 74 of member 76 is in the center of the member and on the central axis of the bullet body 62, and the axial length of projection 74 ranges from 1/10th of an inch (0.1") to ⅓rd of an inch (0.33") depending upon the use to which sabot bullet 60 is put.

Projection 74 orients member 76 to be concentric with the central axis of the bullet body 62, and member 76 stabilizes and keeps the sabots 80 from coming off bullet body 62 in the barrel of the gun prior to exit of the sabot bullet from the gun. This action keeps the sabots 80 aligned more truly with the central axis of the bullet body than if the member 76 were not used. This feature is especially useful at higher gas pressures and higher muzzle velocities. The pusher member 76 also provides a safety feature in that, if a sabot 80 separates from the bullet body in the barrel of a gun, it may cause erratic movement of the sabot bullet before and after leaving the muzzle of a gun.

A further embodiment of the sabot bullet of the present invention is shown in FIG. 5 and is broadly denoted by the numeral 80 and includes a bullet body 82 having a front part 84 and a rear part 85, the rear part having a flat, circular end face 86. A pair of sabots 87 are provided for use with bullet body 82 and each sabot 87 has an inner surface 88 complementary to the outer surface of bullet body 82.

Each sabot 87 has a flat segment 89 integral therewith at the rear end thereof, the segments 89 of the sabots defining a disk-like element 91 (FIG. 5A) which abuts the rear face 86 of bullet body 82 as shown in FIG. 6 when the sabots 89 are mounted on the bullet body.

The segments 89 keep the sabots from separating from bullet body 82 and prevents the change of position of the sabots on the bullet body. The segments 89 are used with low gas pressures; whereas, pusher member 76 of sabot bullet 60 is used for higher gas pressure. At some point, however, pusher member 76 in segments 89 could work in tandem for increased and improved accuracy, higher muzzle velocity and greater safety of use.

I claim:

1. A sabot bullet comprising:

a bullet body having a conical front part and a conical rear part spaced from and converging toward each other with the parts being integral with each and having means extending longitudinally of the bullet body for interconnecting the front and rear parts wherein said connecting means is annular and has a transversely concave outer surface; and a number of sabot segments each having complementary conical converging front and rear cavity portions converging toward an annular connecting portion mounted on and about the bullet body, said sabot segments each having a rear end provided with a transverse disk segment portion, whereby when the sabot segments are mounted on and about the bullet body, the disk segment portions define a disk portion in substantial abutting relation behind the rear part of the bullet body.

* * * * *